US010187932B2

(12) United States Patent
Fattorini et al.

(10) Patent No.: US 10,187,932 B2
(45) Date of Patent: Jan. 22, 2019

(54) METHOD AND DEVICE FOR PROVIDING A UNIQUE IDENTIFIER TO A HOB INDUCTION COIL

(71) Applicant: Electrolux Appliances Aktiebolag, Stockholm (SE)

(72) Inventors: Andrea Fattorini, Forli (IT); Svend Erik Christiansen, Forli (IT); Laurent Jeanneteau, Forli (IT); Alex Viroli, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 161 days.

(21) Appl. No.: 15/125,322

(22) PCT Filed: May 6, 2015

(86) PCT No.: PCT/EP2015/059912

§ 371 (c)(1),
(2) Date: Sep. 12, 2016

(87) PCT Pub. No.: WO2015/173082

PCT Pub. Date: Nov. 19, 2015

(65) Prior Publication Data

US 2017/0079093 A1 Mar. 16, 2017

(30) Foreign Application Priority Data

May 16, 2014 (EP) ..... 14168589

(51) Int. Cl.
*H05B 6/12* (2006.01)

(52) U.S. Cl.
CPC ..... *H05B 6/1209* (2013.01); *H05B 2213/03* (2013.01)

(58) Field of Classification Search
CPC ..... H05B 6/062; H05B 6/12; H05B 6/1209; H05B 6/1236; H05B 2213/03; H05B 2213/05; H05B 2213/06; H05B 2213/07
(Continued)

(56) References Cited

U.S. PATENT DOCUMENTS

2010/0147832 A1 6/2010 Barker, III et al.
2016/0037585 A1 * 2/2016 Christiansen ..... H05B 6/065 219/662

FOREIGN PATENT DOCUMENTS

EP 2 670 214 A1 12/2013
WO 2013/182406 A1 12/2013
WO WO 2014/016032 A1 * 1/2014 ..... H05B 6/062

OTHER PUBLICATIONS

International Search Report and Written Opinion of Corresponding Application No. PCT/EP2015/059912; dated Sep. 10, 2015.

* cited by examiner

*Primary Examiner* — Hung D Nguyen
(74) *Attorney, Agent, or Firm* — Pearne & Gordon LLP

(57) ABSTRACT

A method for assigning a unique identifier to a hob induction coil of an induction hob including a plurality of hob induction coils, the method including the steps of: placing one or more device induction coils of a device above one or more hob induction coils such that at least one device induction coil and at least one hob induction coil are facing each other; establishing a communication link between the device induction coil and the hob induction coil, wherein information regarding a unique identifier is transmitted to the hob induction coil by the device induction coil; and receiving information regarding the unique identifier by the hob induction coil and storing the identifier associated with the hob induction coil within a memory of the induction hob.

14 Claims, 2 Drawing Sheets

(58) Field of Classification Search
USPC ..... 219/620, 622, 624, 625, 626, 662, 663,
219/666, 671, 672, 675
See application file for complete search history.

METHOD AND DEVICE FOR PROVIDING A UNIQUE IDENTIFIER TO A HOB INDUCTION COIL

Generally, the present invention relates to the field of induction hobs. More specifically, the present invention is related to a method and a device for assigning a unique identifier to a hob induction coil.

BACKGROUND OF THE INVENTION

Induction hobs for preparing food are well known in prior art. Induction hobs typically comprise at least one induction heater which is associated with at least one induction coil. For heating a piece of cookware placed on the induction hob, the induction coil is coupled with an electronic power board for providing electrical power to the induction coil.

Induction hobs may comprise multiple induction coils arranged according to an induction coil array. The induction coil array may extend over the whole or essentially the whole cooking surface of the induction hob. For heating a piece of cookware placed on the induction hob array, the induction hob may be adapted to detect, which hob induction coils of said induction hob array are occupied by the piece of cookware in order to power only the occupied hob induction coils.

In order to be able to control the respective hob induction coils each of said hob induction coils may be associated with a unique identifier. By means of said identifier an addressing of each hob induction coil of the induction coil array is possible.

In prior art induction hobs, the hob induction coils of an induction coil array are addressable by connecting each hob induction coil with a specific connector at the electronic power board of the induction hob.

Disadvantageously, the connection of the plurality of hob induction coils may comprise errors leading to a wrong addressing of at least some of said hob induction coils.

SUMMARY OF THE INVENTION

It is an objective of the embodiments of the invention to provide for an improved, error resilient addressing of hob induction coils. The objective is solved by the features of the independent claims. Preferred embodiments are given in the dependent claims. If not explicitly indicated otherwise, embodiments of the invention can be freely combined with each other.

According to an aspect of the invention, the invention relates to a method for assigning a unique identifier to a hob induction coil of an induction hob comprising a plurality of said hob induction coils. The method comprises the steps of:

a) placing one or more device induction coils of a device above one or more hob induction coils such that at least one device induction coil and at least one hob induction coil are facing each other;

b) establishing a communication link between the device induction coil and the hob induction coil, wherein information regarding a unique identifier is transmitted to the hob induction coil by the device induction coil; and c) receiving information regarding the unique identifier by the hob induction coil and storing the identifier associated with the hob induction coil within a memory of the induction hob.

Preferably, the device may be a programming device and may comprise an identifier generator unit being configured for generating a unique identifier per each hob induction coil. By assigning said unique identifier to the hob induction coil an unambiguous addressing of the hob induction coil is possible. Said method is advantageous because the risk of an erroneous addressing is minimized.

According to embodiments, the steps of establishing a communication link, transmitting information regarding a unique identifier, receiving information regarding the unique identifier by the hob induction coil and storing the identifier associated with the hob induction coil are performed for each hob induction coil of said plurality of hob induction coils. Thereby, all hob induction coils are assigned with a unique identifier and can be unambiguously addressed by using said unique identifier. Specifically, said unique identifier may be used for localizing a respective hob induction coil of an induction coil array.

According to embodiments, information regarding unique identifiers is provided to the hob induction coils simultaneously or consecutively. The programming device may generate unique identifiers for all hob induction coils at once and may transmit said unique identifiers at the same time to the respective hob induction coils. Thereby the period of time for transferring the unique identifiers is minimized. Alternatively, the unique identifiers are provided to the hob induction coils one after the other which reduces the hardware and signal handling effort.

According to embodiments, the hob induction coil is powered off while transmitting information regarding the unique identifier to said hob induction coil. Preferably, the hob induction coil is used as receiving coil for receiving electromagnetic radiation comprising identifier information transmitted by the device induction coil (transmitting coil). In other words, the hob induction coil is used in a deactivated state as receiving coil by inducing an electric signal comprising information regarding the unique identifier. The induction hob may comprise a control unit being coupled with the hob induction coil and being adapted for receiving said information regarding the unique identifier. Said control unit may also cover other control capabilities, e.g. pot detection. Said control unit may also control the generation of an induction current being applied to the respective hob induction coil.

According to embodiments, information regarding the unique identifier is transmitted by alternately powering the device induction coil. In other words, an electrical signal applied to the device induction coil is pulse-modulated, wherein using said pulse modulation, information regarding the unique identifier is transmitted to the hob induction coil, respectively the control unit of the induction hob in a coded way.

According to embodiments, the alternately powering of the device induction coil is performed by alternating on/off phases, wherein an alternating current is provided to the device induction coil during the on-phases and the alternating current provided to the device induction coil is switched off during the off-phases. In other words, an alternating pulse-modulated current is applied to the device induction coil. The frequency of the alternating current may be in the frequency range of the induction current being applied to the hob induction coil while heating a piece of cookware placed on said hob induction coil, e.g. in the range of 20 kHz-50 kHz. Alternatively, information regarding the unique identifier is transmitted to the hob induction coil by using amplitude modulation and/or frequency modulation of the electric current provided to the device induction coil.

According to embodiments, information regarding the unique identifier is transmitted to the hob induction coil by transmitting an electromagnetic field by the hob induction coil to the device induction coil, modulating the impedance of a receiving circuit of the device including the device induction coil thereby also modulating the electric load of the hob induction coil and analysing the electric load modulation by means of a control unit of the induction hob. In other words, the hob induction coil is actively operated by applying electric current to the hob induction coil and the electric load is varied according to a load pattern, wherein said load pattern comprises coded information regarding the unique identifier. Said load pattern may be detected by a load detection unit of the induction hob and may be decoded in order to receive the unique identifier information.

According to embodiments, the device may comprise a single device induction coil being adapted to the size of a single hob induction coil. Thereby a programming device with a reduced system effort is obtained.

According to further embodiments, the device comprises an induction coil array including one device induction coil per each hob induction coil and wherein each device induction coil is facing a hob induction coil when placing the induction coil array on the induction hob. By using a programming device with such induction coil array, no movement of the device induction coil is necessary and all hob induction coils can be applied with unique identifiers after aligning the induction coil array according to the hob induction coils. Thereby, a time-saving assignment of unique identifiers to the hob induction coils is possible.

According to a further aspect, the invention refers to a device for assigning a unique identifier to a hob induction coil of an induction hob, the induction hob comprising a plurality of said hob induction coils, wherein the device comprises:

- at least one device induction coil being adapted to be placed on a hob induction coil;
- an identifier generator unit for generating a unique identifier to be assigned to the hob induction coil;
- a signal generator unit being adapted to generate an electrical signal comprising information regarding the unique identifier or a load varying unit being adapted to vary the electric load according to a load pattern wherein the load pattern comprises information regarding the unique identifier;

wherein the signal generator unit or the load varying unit is coupled with the device induction coil for providing information regarding the unique identifier to the hob induction coil.

According to a further aspect, the invention refers to an induction hob comprising a plurality of hob induction coils, a control unit being adapted to receive information regarding a unique identifier per each hob induction coil, wherein the control unit is coupled with the hob induction coils for receiving a unique identifier per each hob induction coil and wherein the induction hob further comprises a memory unit for storing the unique identifier associated with each hob induction coil.

According to an embodiment, the control unit comprises a decoding unit for decoding the information regarding a unique identifier.

The terms "essentially", "substantially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
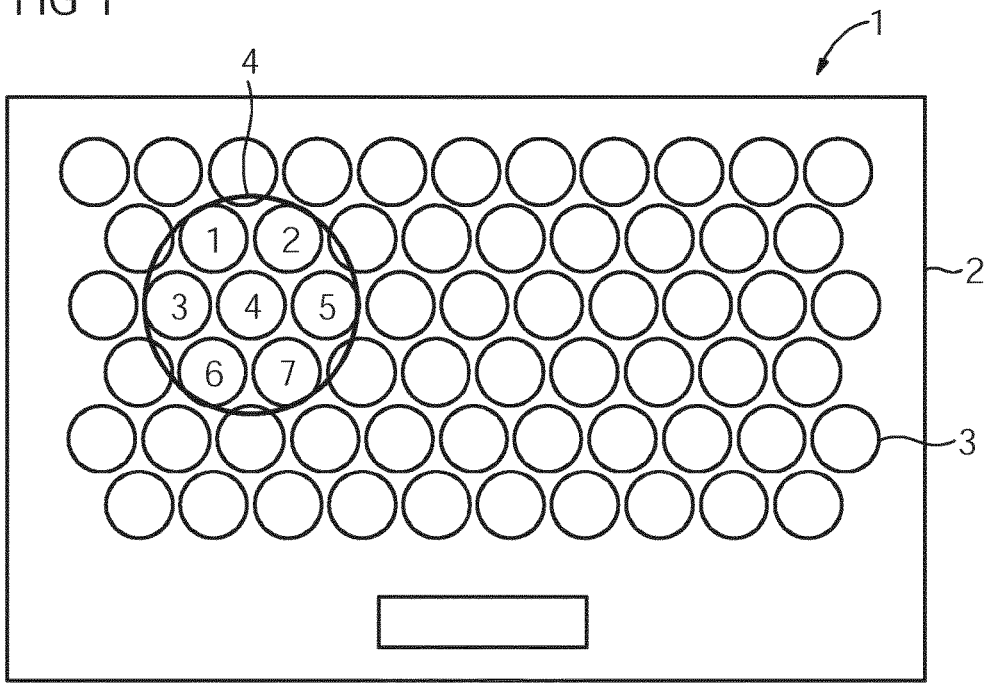
FIG. 1 shows an example schematic top view of an induction hob.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows an induction hob according to an embodiment. The induction hob 1 comprises a cooking surface 2, e.g. a glass ceramic plate and a plurality of hob induction coils 3 which are placed beneath the cooking surface 2. The hob induction coils 3 may be arranged in a matrix-like manner. The hob induction coils 3 form heating elements being adapted to heat a piece of cookware 4 placed on the cooking surface 2 by induction heating. Said hob induction coils 3 may not only be used to cook or heat the food contained in the piece of cookware 4, but also to identify the position of the overlying piece of cookware 4. When a piece of cookware 4 is disposed in any position on the induction hob 1, its position is identified, with consequent determination of which hob induction coils 3 lie below said piece of cookware (according to FIG. 1, induction coils 1 to 7 are placed below the cookware). Only these hob induction coils 3 being occupied by the piece of cookware will be activated during heating the piece of cookware 4. In order to be able to identify which hob induction coils 3 are covered by the piece of cookware, respectively, which hob induction coils 3 have to be activated, each hob induction coil 3 is correlated with a unique identifier. Said unique identifier may be used for addressing the respective hob induction coils 3.

Figure 2:
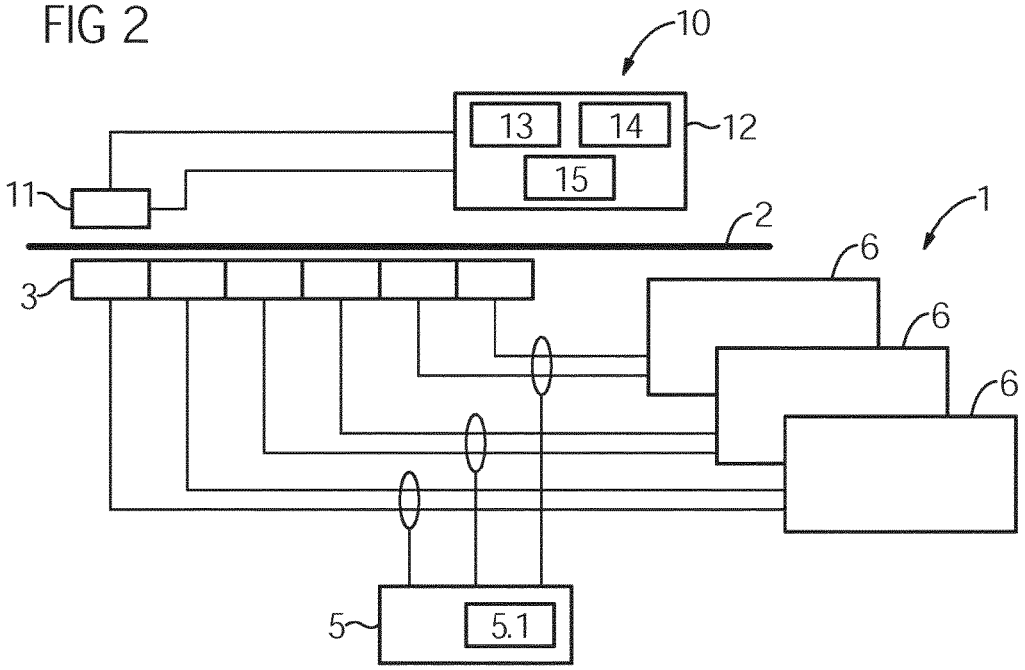
FIG. 2 shows an example schematic side view of an arrangement of a device for assigning unique identifiers and an induction hob according to a first embodiment.

FIG. 2 shows an arrangement of a device 10 and an induction hob 1 for assigning unique identifiers to the hob induction coils 3 of the induction hob 1. The device 10 may be a programming device configured to transfer identifiers to the induction hob 1 during factory production. It comprises a device induction coil 11 being coupled with a basic unit 12 of the device 10. The basic unit 12 may comprise an identifier generator unit 13 and a signal generator unit 14, respectively, a load varying unit 15. The identifier generator unit 13 may be adapted to generate a unique identifier which may be associated with a respective hob induction coil 3 of the induction hob 1. The identifier generator unit 13 may be coupled with the signal generator unit 14, respectively, the load varying unit 15 in order to provide the generated identifier to the signal generator unit 14, respectively, load varying unit 15.

The signal generator unit 14 may be adapted to generate an electrical signal comprising information regarding the unique identifier provided by the identifier generator unit 13. More in detail, the signal generator unit 14 may generate an electrical signal which may be transmitted to the device induction coil 11. Said electrical signal may include information regarding the unique identifier.

For transmitting information regarding the unique identifier to the hob induction coil 3, the device induction coil 11 may be located in close proximity to the hob induction coil 3 which should be assigned with said unique identifier. Thereby, an inductive coupling between the device induction coil 11 and the hob induction coil 3 is achieved. Due to said inductive coupling information regarding the unique identifier is transmitted to the hob induction coil 3.

Within the hob induction coil 3 an alternating current may be induced due to the electrical signal provided to the device induction coil 11. Said induced alternating current may also comprise information regarding the unique identifier. Said information may be received by a control unit 5 of the induction hob 1. The control unit 5 may be coupled with a memory in which the unique identifier is stored. Thereby, the unique identifier may be associated to the hob induction coil 3 by which the information regarding the unique identifier has been received. The generator unit 6 of the induction hob may be powered off, i.e. the hob induction coil 3 is operated in receiving mode.

The unique identifier may be transmitted in a coded way, e.g. by a digital or analogue coding. For example, a communication protocol, specifically a standard protocol may be used for transmitting the unique identifier. The control unit 5 of the induction hob 1 may be adapted to decode said information in order to receive the unique identifier. Specifically, the control unit 5 may comprise a decoding unit 5.1 for decoding said information.

According to another embodiment, the hob induction coil 3 is operated in generating mode and the information regarding the unique identifier is provided from the device 10 to the induction hob 1 by alternating the load provided to the hob induction coil 3. Similar to the embodiment described above, the device induction coil 11 is placed in close proximity to the hob induction coil 3 wherein the hob induction coil 3 and the device induction coil 11 are facing each other. The generator unit 6 of the induction hob 1 may generate an electrical alternating signal which is provided to the hob induction coil 3. The hob induction coil 3 may transmit an electromagnetic radiation which is received by the device induction coil 11. Thereby an alternating current is induced within the device induction coil 11. The load varying unit 15 of the device 10 may be adapted to vary the load seen at the device induction coil 11 according to a predefined pattern. The pattern may depend on the unique identifier provided by the identifier generating unit 13. In other words, the load variation pattern represents coded information regarding the unique identifier to be assigned to the hob induction coil 3.

The control unit 5 correlated with the hob induction coil 3 may comprise a load detection unit. The load detection unit may be adapted to determine the electric load being effective at the hob induction coil 3. Thereby, the electric load pattern comprising information regarding the unique identifier may be processed by the control unit 5. Specifically, the control unit 5 may comprise decoding means for obtaining the unique identifier out of the electric load pattern. The control unit 5 may be coupled with a memory in which the unique identifier is stored. Thereby, the unique identifier may be associated to the hob induction coil 3 by which the electric load pattern comprising information regarding the unique identifier has been received.

Figure 3:
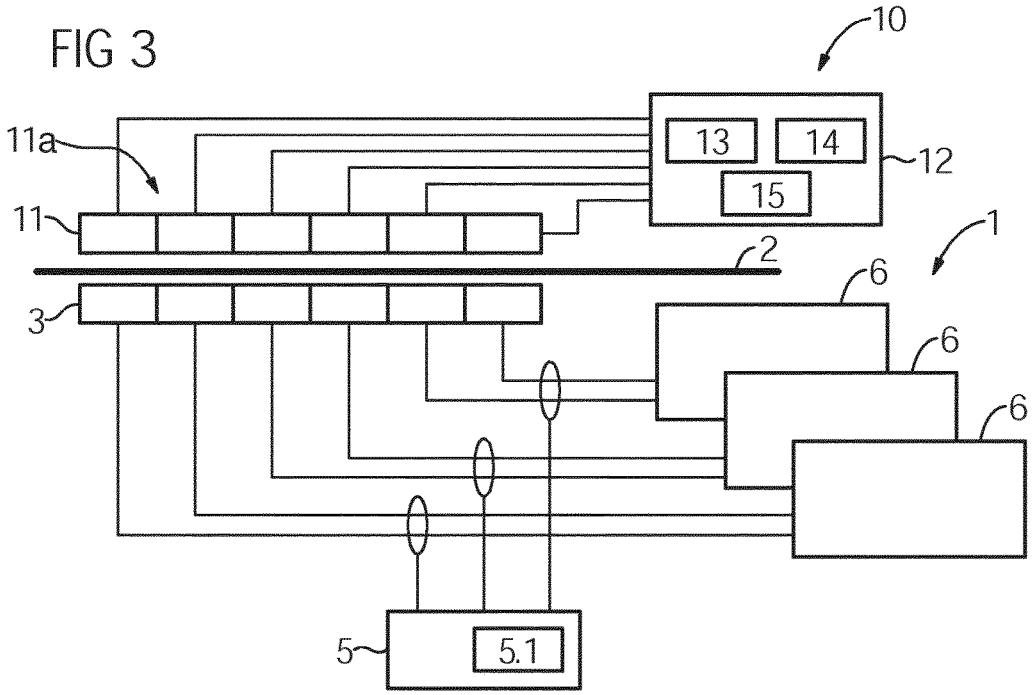
FIG. 3 shows an example schematic side view of an arrangement of a device for assigning unique identifiers and an induction hob according to a second embodiment.

FIG. 3 shows a further embodiment of an arrangement of a device 10 and an induction hob 1 for assigning unique identifiers to the hob induction coils 3 of the induction hob 1. The device 10 comprises an induction coil array 11*a* comprising a plurality of induction coils 11. The induction coil array 11*a* may be adapted to the arrangement of hob induction coils 3 provided at the induction hob 1. Specifically, the induction coil array 11*a* may comprise an identical number of device induction coils 11 as the induction hob 1 and the device induction coils 11 and the hob induction coils 3 are arranged identically so that each device induction coil 11 is facing a hob induction coil 3 when placing the induction coil array 11*a* on the cooking surface. Each device induction coil 11 may be coupled with the basic unit 12 of the device 1.

The induction hob 1 may comprise one or more generator units 6, each generator unit 6 being coupled with one or more hob induction coils 3 for providing an induction current signal to the hob induction coils 3. Furthermore, the induction hob 1 may include one or more control units 5, the control unit 5 being coupled with one or more of said generator units 6.

Similarly to the embodiment according to FIG. 2 described above, the device 1 is adapted to assign a unique identifier to the hob induction coils 3 of the induction hob by providing coded information comprising said unique identifier. In this respect, reference is made to the embodiments of transferring the unique identifier to the induction hob 1 via the hob induction coil 3 described above. The main advantage of the device 10 comprising an induction coil array 11*a* including a plurality of device induction coils 11 is that each hob induction coil 3 can be correlated with a unique identifier without changing the location of the device induction coils 11. The induction coil array 11*a* may be once aligned to the hob induction coils 3 of the induction hob 1 and all hob induction coils 3 can be correlated with a unique identifier iteratively or simultaneously. Therefore, the number handling effort is significantly reduced.

Figure 4:
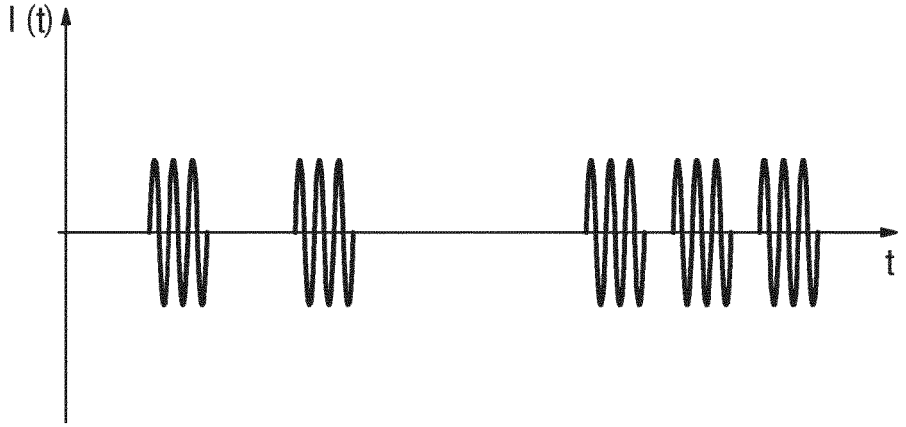
FIG. 4 shows a pulse-coded alternating current signal comprising information regarding a unique identifier.

FIG. 4 shows a time-dependent signal, namely the time-dependent current provided to the hob induction coil 3 via the device induction coil 11 in order to transmit information regarding the unique identifier to the induction hob. As mentioned before, the information may be transmitted in a coded way, e.g. by pulse coding. More in detail, the signal generator unit 14 may be adapted to provide an alternating current signal with a fixed frequency, e.g. a signal in the range of 20-50 kHz, specifically 30 kHz, which is binary pulse modulated by turning the signal on/off. For example, the presence of an AC-current at a certain point of time represents logic "1" and the absence of a AC-current at a certain point of time represents logic "0". Thus, information regarding the unique identifier may be transferred in a serial way bit-by-bit, e.g. using similar principles as Universal Asynchronous Receiver Transmitter (UART) or Serial Communication Interface (SCI) devices. Said binary pulse modulation may also be used when transferring information regarding the unique identifier to the induction hob 1 by varying the load of the device induction coil as described before. Specifically, the load may be varied between a high load situation and a reduced load situation in order to transfer the information from the device 10 to the induction hob 1.

Alternatively, the information regarding the unique identifier may be transferred by using a frequency or amplitude modulation coding or any other suitable coding being capable for transferring said information.

Above, embodiments of a method for assigning a unique identifier to a hob induction coil of an induction hob, a device for assigning a unique identifier to a hob induction coil and a induction hob according to the present invention as defined in the appended claims have been described. These should be seen as merely non-limiting examples. As understood by a skilled person, many modifications and alternative embodiments are possible within the scope of the invention.

LIST OF REFERENCE NUMERALS

1 induction hob
2 cooking surface
3 hob induction coil
4 cookware
5 control unit
5.1 decoding unit
6 generator unit
10 device
11 device induction coil
11*a* induction coil array
12 basic unit
13 identifier generator unit
14 signal generator unit
15 load varying unit

The invention claimed is:

1. A method for assigning a unique identifier to a hob induction coil of an induction hob comprising a plurality of said hob induction coils, the method comprising the steps of:

a. placing one or more device induction coils of a device above one or more of said hob induction coils such that at least one said device induction coil and at least one said hob induction coil are facing each other;

b. establishing a communication link between the device induction coil and the hob induction coil, wherein information regarding a unique identifier is transmitted to the hob induction coil by the device induction coil; and c. receiving information regarding the unique identifier by the hob induction coil and storing the identifier associated with the hob induction coil within a memory of the induction hob.

2. The method according to claim 1, wherein the steps of establishing a communication link, transmitting information regarding a unique identifier, receiving information regarding the unique identifier by the hob induction coil and storing the identifier associated with the hob induction coil are performed for each hob induction coil of said plurality of hob induction coils.

3. The method according to claim 2, wherein information regarding unique identifiers is provided to the hob induction coils simultaneously or consecutively.

4. The method according to claim 1, wherein the hob induction coil is powered off while transmitting information regarding the unique identifier to said hob induction coil.

5. The method according to claim 1, wherein information regarding the unique identifier is transmitted by alternately powering the device induction coil.

6. The method according to claim 5, wherein alternately powering the device induction coil is performed by alternating on/off phases, wherein an alternating current is provided to the device induction coil during the on-phases and the alternating current provided to the device induction coil is switched off during the off-phases.

7. The method according to claim 1, wherein information regarding the unique identifier is transmitted to the hob induction coil by using an amplitude modulation and/or frequency modulation of the electric current provided to the device induction coil.

8. The method according to claim 1, wherein information regarding the unique identifier is transmitted to the hob induction coil by transmitting an electromagnetic field by the hob induction coil to the device induction coil, modulating the impedance of a receiving circuit of the device being coupled with the device induction coil thereby also modulating the electric load of the hob induction coil and analysing the electric load modulation by means of a control unit of the induction hob.

9. The method according to claim 1, wherein a control unit coupled with the hob induction coil decodes the information regarding the unique identifier received at the hob induction coil.

10. The method according to claim 1, wherein the device comprises a single device induction coil being adapted to the size of a single hob induction coil.

11. The method according to claim 1, wherein the device comprises an induction coil array including one device induction coil per each hob induction coil and wherein each device induction coil is facing a hob induction coil when placing the induction coil array on the induction hob.

12. A device for assigning a unique identifier to a hob induction coil of an induction hob, the induction hob comprising a plurality of said hob induction coils, wherein the device comprises:

at least one device induction coil being adapted to be placed on one of said hob induction coils;

an identifier generator unit for generating a unique identifier to be assigned to the hob induction coil;

a signal generator unit being adapted to generate an electrical signal comprising information regarding the unique identifier or a load varying unit being adapted to vary the electric load according to a load pattern wherein the load pattern comprises information regarding the unique identifier;

wherein the signal generator unit or the load varying unit is coupled with the device induction coil for providing information regarding the unique identifier to the hob induction coil.

13. An induction hob comprising a plurality of hob induction coils, a control unit being adapted to receive information regarding a unique identifier per each said hob induction coil, wherein the control unit is coupled with the hob induction coils for receiving a unique identifier per each said hob induction coil and wherein the induction hob further comprises a memory unit for storing the unique identifier associated with each said hob induction coil.

14. The induction hob according to claim 13, wherein the control unit comprises a decoding unit for decoding the information regarding a unique identifier.

* * * * *